US009058799B2

(12) United States Patent
Algargoosh et al.

(10) Patent No.: US 9,058,799 B2
(45) Date of Patent: Jun. 16, 2015

(54) SOUND DIFFUSER INSPIRED BY CYMATICS PHENOMENON

(71) Applicant: UNIVERSITY OF DAMMAM, Dammam (SA)

(72) Inventors: Alaa Salman Abdullah Algargoosh, Mahamdiah (SA); Hany Elsayed Ali Hossameldin, Dammam (SA); Hala Abdelmonem Mohmoud El-Wakeel, Dammam (SA)

(73) Assignee: University of Dammam, Dammam (SA)

( * ) Notice: Subject to any disclaimer, the term of this patent is extended or adjusted under 35 U.S.C. 154(b) by 0 days.

(21) Appl. No.: 14/279,077

(22) Filed: May 15, 2014

(65) Prior Publication Data

US 2014/0339015 A1 Nov. 20, 2014

(30) Foreign Application Priority Data

May 16, 2013 (SA) ..... 113340557

(51) Int. Cl.
*E04B 1/82* (2006.01)
*E04B 1/86* (2006.01)
*G10K 11/16* (2006.01)

(52) U.S. Cl.
CPC ..... *G10K 11/16* (2013.01)

(58) Field of Classification Search
CPC ..... E04B 1/82; E04B 1/86
USPC ..... 181/293, 284
See application file for complete search history.

(56) References Cited

U.S. PATENT DOCUMENTS

| | | | | |
|---|---|---|---|---|
| 4,821,839 | A * | 4/1989 | D'Antonio et al. | 181/198 |
| 5,027,920 | A * | 7/1991 | D'Antonio et al. | 181/285 |
| 5,226,267 | A * | 7/1993 | D'Antonio et al. | 52/144 |
| 6,772,859 | B2 * | 8/2004 | D'Antonio et al. | 181/293 |
| 6,793,037 | B1 * | 9/2004 | Babuke et al. | 181/293 |
| 7,261,182 | B2 * | 8/2007 | Zainea | 181/293 |
| 7,604,094 | B2 * | 10/2009 | Magyari | 181/286 |
| 7,771,517 | B2 * | 8/2010 | Dralle | 95/273 |
| 2005/0167193 | A1 * | 8/2005 | Van Reeth | 181/293 |
| 2005/0279574 | A1 * | 12/2005 | Halterbeck et al. | 181/293 |
| 2006/0042875 | A1 * | 3/2006 | Zainea | 181/293 |
| 2012/0018247 | A1 * | 1/2012 | Gideonse | 181/293 |

* cited by examiner

*Primary Examiner* — Forrest M Phillips
(74) *Attorney, Agent, or Firm* — Oblon, McClelland, Maier & Neustadt, L.L.P.

(57) ABSTRACT

Sound diffusers are important components in enhancing the quality of room acoustics. The present disclosure relates to a sound diffuser obtained by using properties of the cymatics phenomena. Cymatics is the study of sound and vibration made visible, typically on the surface of a plate, diaphragm or membrane. Two examples of diffusers are designed by the cymatic shapes and modeled by using a quadratic quadratic residue sequence. It is found that this type of acoustic diffusers can be used to maintain the acoustic energy in a room and at the same time can treat unwanted echoes and reflections by scattering sound waves in many directions. The design allows for creating different interior space designs by changing the arrangement of the diffuser panels, and this leads to different applications for the diffusers.

20 Claims, 15 Drawing Sheets

SOUND DIFFUSER INSPIRED BY CYMATICS PHENOMENON

CROSS-REFERENCE TO RELATED APPLICATIONS

The present application claims the benefit of the earlier filing date of Saudi Arabian application serial no. 113340557 filed in Saudi Arabia on May, 16, 2013 entitled "Sound Diffusers Inspired by Cymatics Phenomenon", the entire contents of which being incorporated herein by reference.

BACKGROUND

1. Field of the Disclosure

The present disclosure relates to a sound diffuser obtained by using properties of a cymatics phenomenon. Cymatics is the study of sound and vibration made visible, typically on a surface of a plate, diaphragm or membrane. The design of a cymatic sound diffuser allows the maintenance of acoustic energy in a room treats unwanted echoes and reflections and provides a wide variety of design solutions that can be utilized to fulfil special acoustic requirements simultaneously.

2. Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

Diffusion is one of the means of changing acoustic phenomenon. It is the efficiency of sound energy distribution in a given environment. Quality of indoor environment is considered one of the main elements of sustainable buildings. The indoor environment includes indoor air quality, thermal comfort, lighting and acoustics. Virtuous architecture involves the correct usage of sound absorbers and diffusers; this is a vital aspect of acoustics, and has a direct effect on the comfort, efficiency and well-being of the occupants.

The role of diffusers has been developed more in the recent days than that of absorbers. This is because most of the absorbers contain porous materials derived from synthetic fibers, such as mineral wool or glass wool, which are considered harmful to human health, and do not stand up well to the effects of wind, rain and toxic environments.

A Schroeder diffuser, sometimes called a reflection phase grating, is a patent that scatters sound waves. It has a structure including a number of wells of different, particular depths. As a soundwave strikes the irregular surface, instead of bouncing off it like a mirror, it bounces out of each well at a slightly different time, and thus spreads out the acoustic wave into smaller wavelets that are distributed in time and space.

Cymatics is the study of visible sound and vibration, where the observation is often made of the modes of vibration of a structure resulting from a frequency source applied to the structure. A Chlandi plate is an example of cymatic observation, where a plate covered with sand is excited with a frequency source and the sand forms patterns at the nodes and anti-nodes on the plate, representative of the standing vibration waves when in resonance. A quadratic-residue diffusor (QRD) is a type of Schoeder diffusor with well depths calculated according to well depth=(well positon)^2 mod N, where N is a number of wells and is a prime number.

SUMMARY

As recognized by the present inventors, even though the effectiveness of a conventional Schroeder diffuser has been shown, there is a need to improve this type of diffuser to allow it to fit with new architectural forms. Architecture has been greatly influenced by advances in engineering allowing new and unimaginable shapes to be constructed. There are different shapes of diffuser panels, but all have a fixed and rigid design regardless of the number and location of panels used, limiting architectural design creativity. The present disclosure relates to novel designs of sound diffusers obtained by the cymatics phenomenon. The diffusers are designed to have specific curves based on cymatic shapes, and are calculated according to a quadratic-residue diffusors (QRD) sequence.

An advantage of this disclosure is an improvement of indoor sound quality using cymatics in designing diffusers while providing a wide variety of diffuser designs. This offers an artistic and creative visual appearance in addition to decent sound performance. The designs are aesthetically appealing, flexible, and have different applications. Therefore, depending on the arrangement, different configurations show different acoustical behaviors affecting the room's acoustical parameters. The variety of designs leads to a variety of applications; one panel design can provide several creative designs that fit with the interior of the space according to its function and its acoustical requirements.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1:
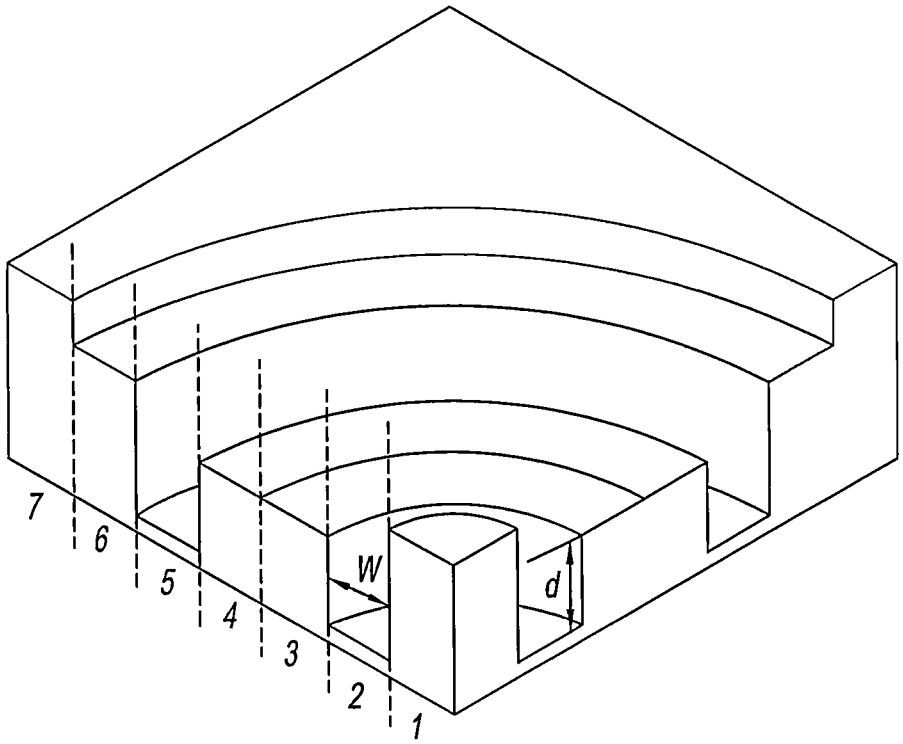
FIG. 1 is an isometric illustration of a first sound diffuser according to one example embodiment.

Referring now to the drawings, wherein like reference numerals designate identical or corresponding parts throughout the several views.

The diffusers of the present disclosure are used when sound energy needs to be conserved. A cymatic QRD diffuser design as disclosed herein is more effective than the existing QRD diffuser in design. The benefit includes the spaces where sound plays an important role, such as auditoriums, worship places, performance spaces, concert halls, recording studios, ballrooms, theatres, multi-purpose rooms, etc., and spaces in which speech intelligibility is important, such as classrooms, courtrooms, boardrooms, etc.

The diffusers may be designed in different cymatic shapes allowing a vast range of designs and creativity. However, the designed cymatic diffusers may be constructed on a panel and fins may be disposed on the panel. Each adjacent pair of fins being separated by a common predetermined distance or different predetermined distance. The space between each of the dividers is called a "well", the fins may be used to separate wells within a diffuser.

In another embodiment, groves or wells may be formed in the panel. The depths and proportions of the wells are varied and may be determined using a quadratic residue series (QRD), a primitive-root series or other series created with a mathematical algorithm or at random, but in one embodiment the QRD series is used to define well depth.

The designed sound diffusers may be constructed of wood, metal, studiofoam, thermoplastic or any other material suitable for sound diffusion, but preferably the material used is wood. Wood can be painted to reduce absorption and increase reflection and vice versa. The designed diffusers have square shapes and the number of wells is determined from cymatic shapes that are determined empirically or by observation from similar shaped plat panels that are excited at particular frequencies with a frequency generator so the resonance patterns emerge on the panel. Once the pattern emerges for that frequency, the different anti-nodes in the resonance pattern identify the well locations and number The depth of the wells are determined by calculation such as by QRDude calculator where well depths are calculated according to eqn 1.

$$\text{well depth}=(\text{well position})\hat{}2 \bmod N, \qquad \text{eqn 1}$$

where N is a number of wells and is also a prime number eqn 1

Installation of the diffusors of the present disclosure may take many forms, depending on the design, shape, size and weight of the diffusor, as well as the desired acoustic properties of the space. Some likely installations are by hanging the diffusor from a wall, a ceiling or both, or any suitable installation. Furthermore, different cymatic shapes may be mounted on a single panel to diffuse particular acoustic frequencies, such as one or more of the diffusers 21-26 in FIG. 7 may be mounted on the same panel 700, or multiple panels with one diffuser each may be mounted adjacent to each other on a wall.

Figure 2:
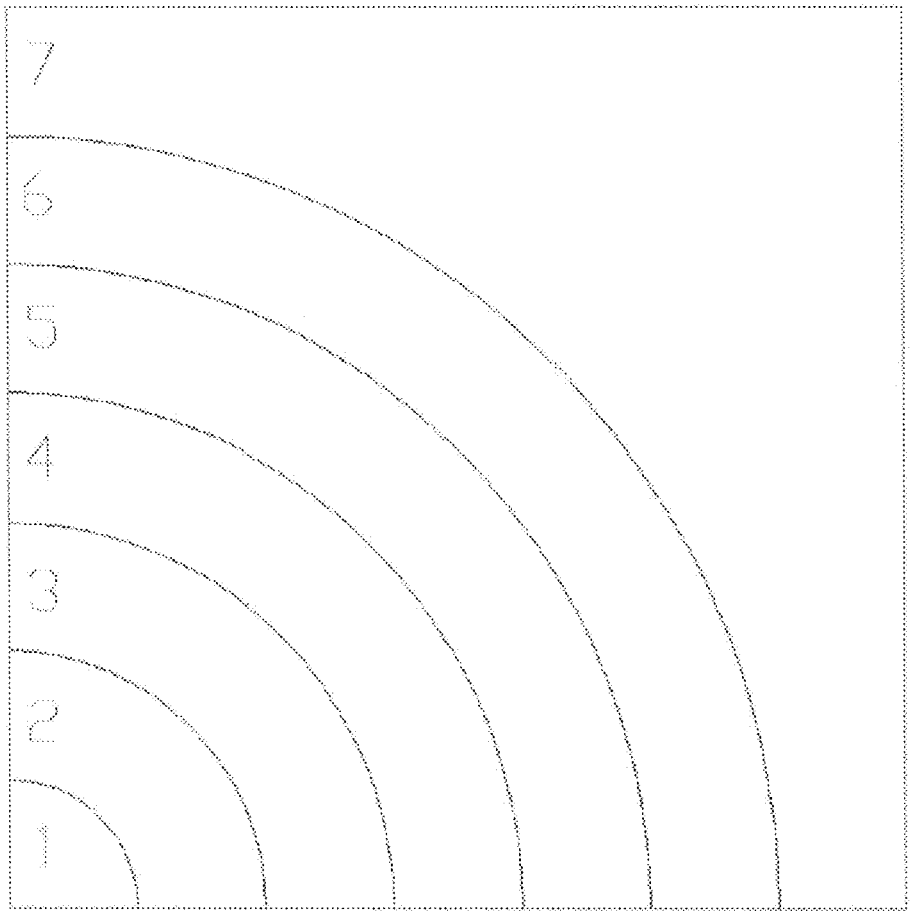
FIG. 2 is a schematic illustration of a top view of the first sound diffuser according to a first example embodiment.
Figure 3:
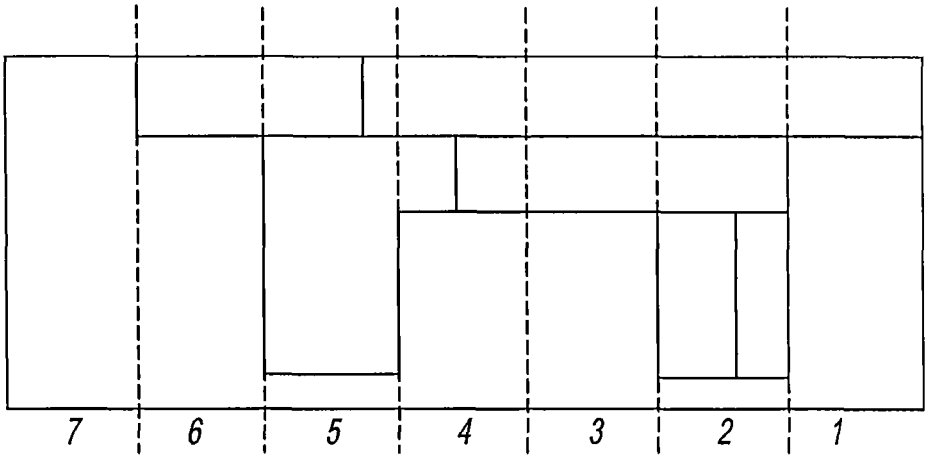
FIG. 3 is a schematic illustration of a side view of the first sound diffuser according to the first example embodiment.

FIGS. 1, 2 and 3 are schematic illustrations of a first sound diffuser. In each of FIGS. 1, 2 and 3, wells are labeled 1, 2, 3, 4, 5, 6, and 7 respectively. In figure one the letter "w" is shown to define the width of a well, and "d" is shown to define the depth of the well. The widths of the wells may be of equal values or different values depending on the cymatic shapes used to construct the diffuser.

In one embodiment, the diffuser can include any number of wells and can conserve sound on any range of frequency that matches the calculations of eqn. 1 for a well's depth and the QRD sequence for the frequency range.

In another embodiment the calculations can be done using a QRD calculator available on-line at various sites such as http://www.subwoofer-builder.com/qrdude.htm.

In a particular example, the first diffuser illustrated in FIGS. 1-3, includes 7 wells and has a usable frequency range of 415 and 2,866 Hz. FIG. 3 shows the heights of the 1-7 wells as being 89, 0, 60, 60, 0, 89, 119 mm respectively.

Figure 4:
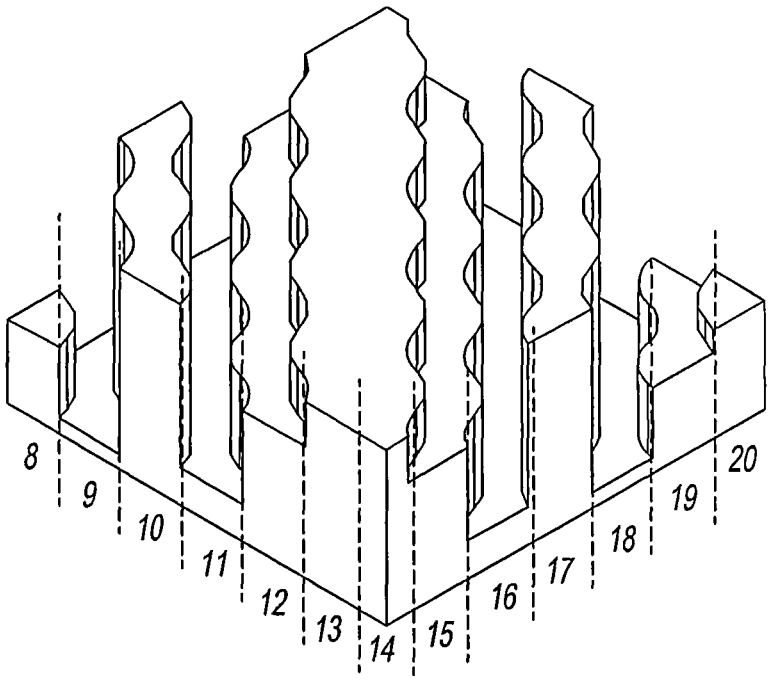
FIG. 4 is an isometric illustration of a second sound diffuser according to a second example embodiment.
Figure 5:
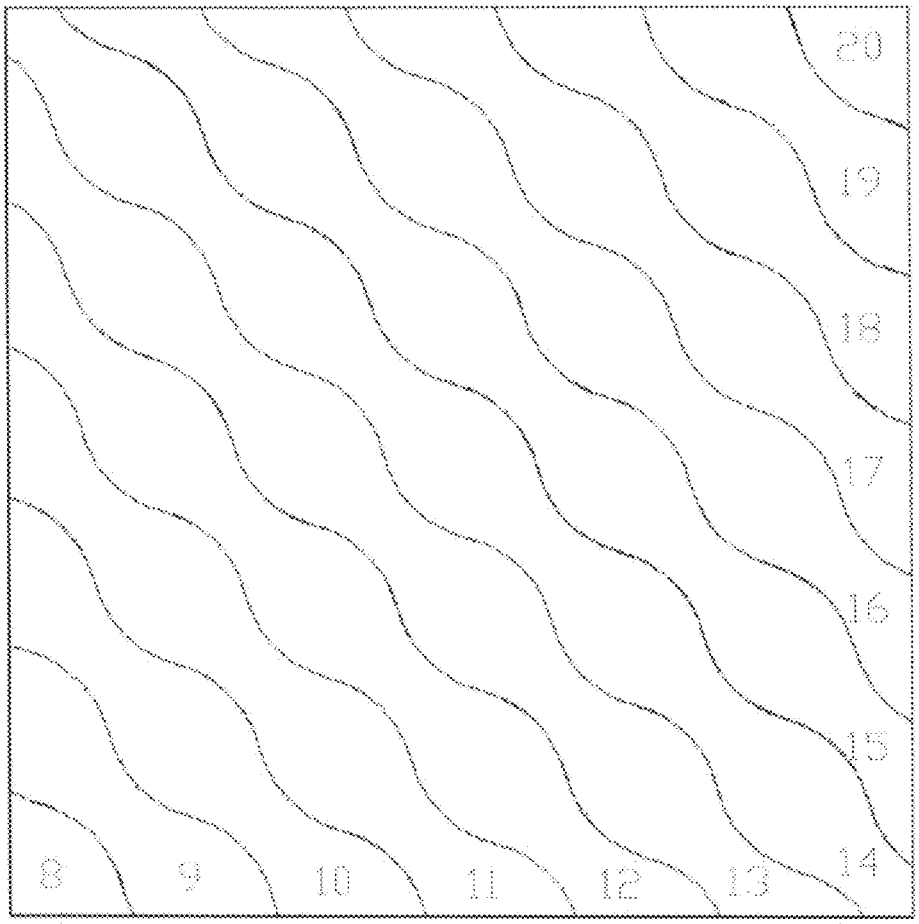
FIG. 5 is a schematic illustration of a top view of the second sound diffuser according to the second example embodiment.
Figure 6:
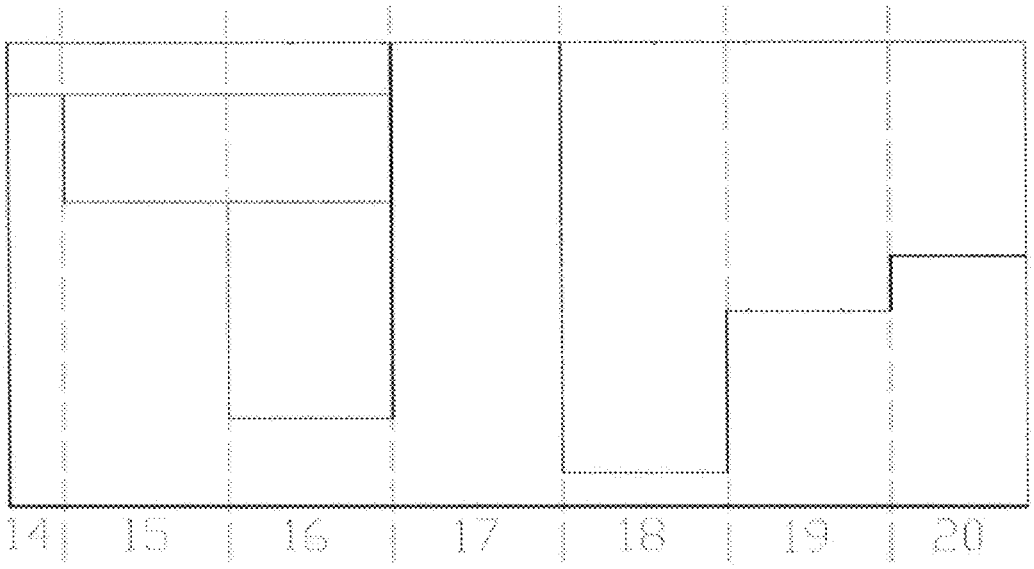
FIG. 6 is a schematic illustration of a cross-section of the second sound diffuser according to the second sample example.

FIGS. 4, 5 and 6 are schematic illustrations of a second sound diffuser. In one embodiment the second sound diffuser illustrated in FIGS. 4-6 includes 13 wells, labeled 8, 9, 10, 11, 12, 13, 14, 15, 16, 17, 18, 19, and 20 and has a usable frequency range of 415-5,212 Hz. FIG. 6 shows the heights of the 8-20 wells as being are 64, 84, 0, 128, 16, 80, 112, 112, 80, 16, 128, 0 and 48 mm respectively.

Different arrangements of the same diffuser can result in different shapes for suppressing different frequency ranges, and can be combined on a single panel to suppress multiple a broader ranges of acoustic frequencies.

Figure 7:
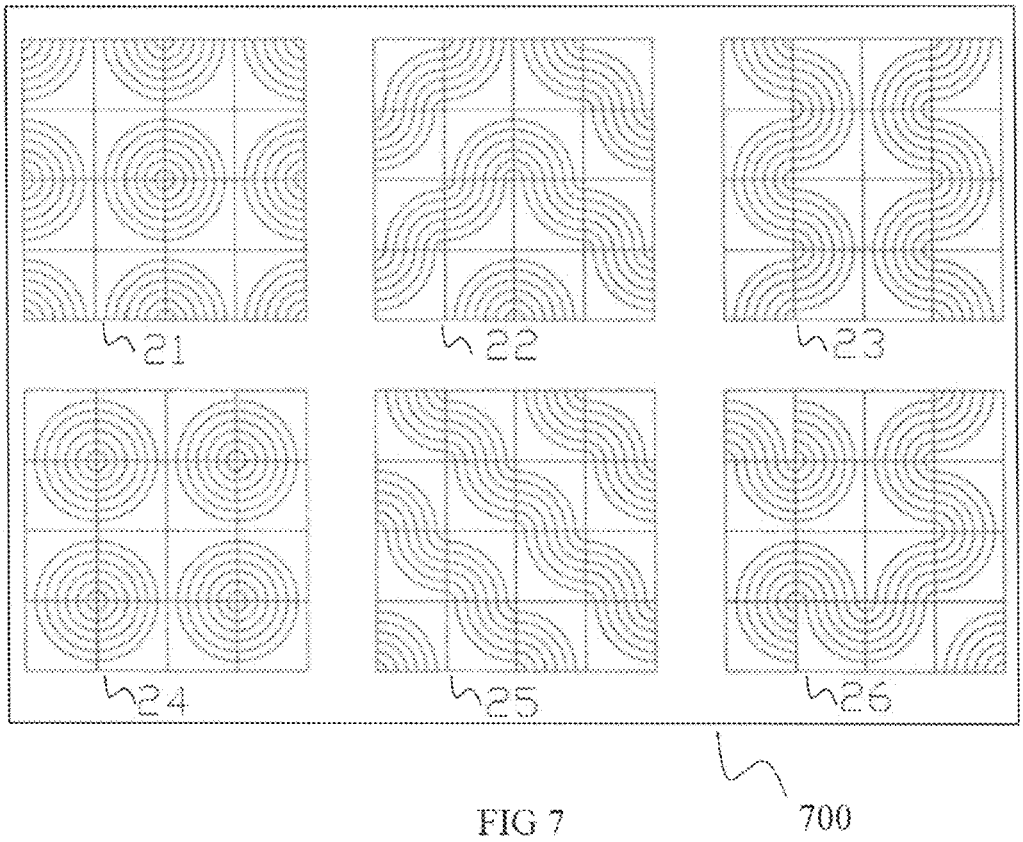
FIG. 7 is a schematic illustration of showing six different possible arrangements for sound diffusers according to the present disclosure.

FIG. 7 is a schematic illustration of different alternative arrangements for the first sound diffuser. The arrangement of the diffusers gives a variety of architectural designs, and at the same time can be utilized to fulfill special acoustical requirements such as controlling reverberation time. Diffuser 21 in FIG. 7 can be used to increase sound warmth as it has the highest T30 value at low frequencies, where T30 is the reverberation time that measures the persistence of sound in the space.

Diffuser 22 in FIG. 7 can be used in recording studios because it generates a more spatially uniform pattern at different frequencies and angles, and it has the least difference between the minimum and maximum values of T30. Diffusers 23-26 in FIG. 7 illustrate different possible arrangements that will change the shape of the combined panel affecting how the diffuser diffuses sound energy, while in parallel vertical and horizontal lines diffusers different arrangement will always lead to a fixed shape and effect of the diffuser.

Generally, the diffusers can be used to improve the speech intelligibility at all frequencies within the usable frequency range 400-4000 Hz, and they work better for speech in settings such as control rooms (recording and broadcasting studios), conference rooms and lecture halls.

Acoustic performance of the first and second sound diffusers can be evaluated through measuring some acoustic parameters. Acoustic parameters include but are not limited to reverberation time, clarity, sound strength, spaciousness, timbre or tone color (balance between hi, med, low frequencies), sound definition, echo criterion and speech intelligibility.

Acoustical requirements of an architectural project may be achieved using diffusors of the present disclosure. For example, the first and second diffusors can be used to improve indoor sound quality by evenly scattering sound in all directions, and reducing coloration and echo control.

The efficiency of the designed diffusers is investigated by testing the diffusivity of the diffusers, and then comparing it with the diffusivity of a flat panel. Diffusivity can be determined by examining the diffuser polar response to study the spatial dispersion in all directions in one-third octave bands.

The ideal diffuser should distribute sound energy evenly in all directions, this means that the perfect polar response should look like a semicircle.

Figure 8:
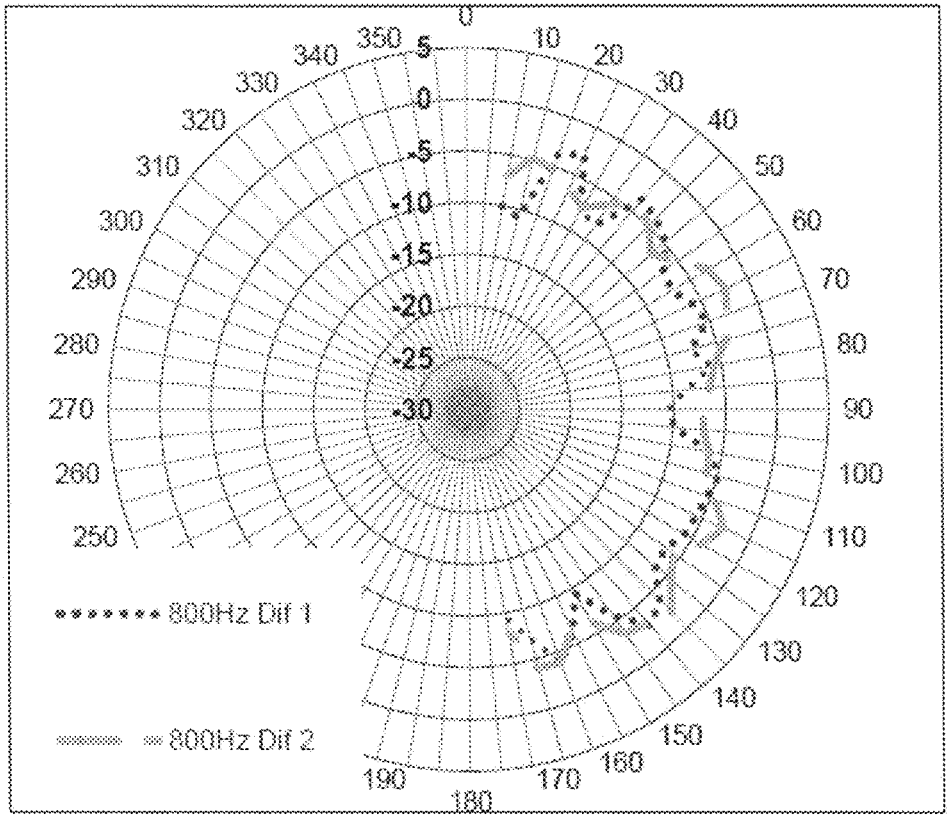
FIG. 8 is a scattered sound polar distribution at 800 Hz for the first and second sound diffusers of FIGS. 2 and 4.
Figure 9:
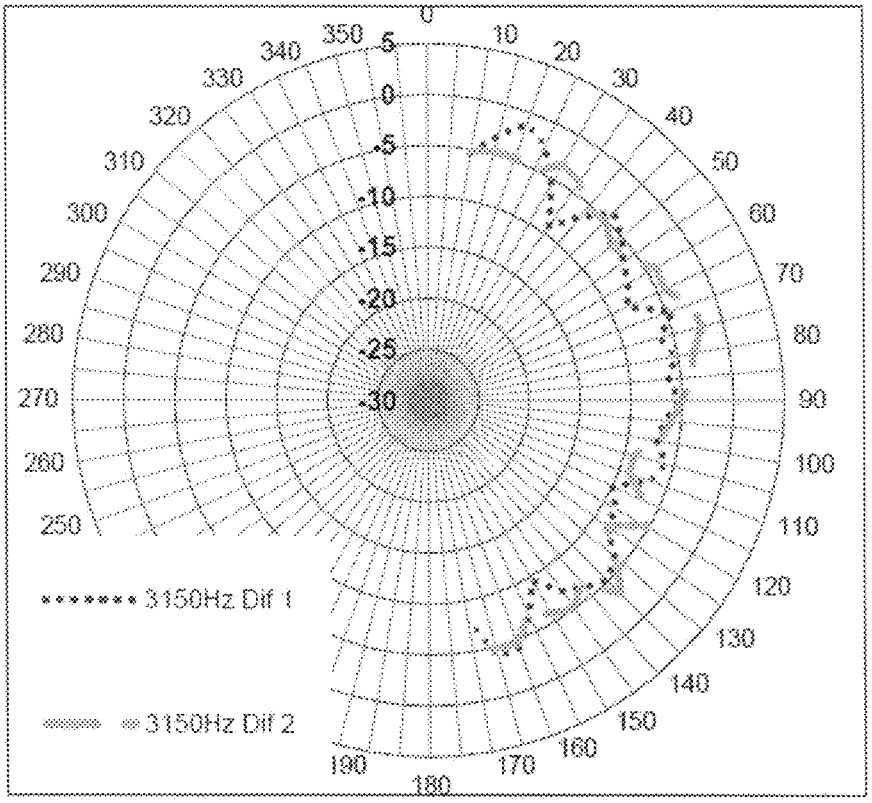
FIG. 9 is a scattered sound polar distribution at 3150 Hz for the first and second sound diffusers according to FIGS. 2 and 4.

FIGS. 8 and 9 show the polar impulse response for the first and second designed sound diffusers. When using the first and second sound diffusers, the sound energy starts to distribute in a more even way at the usable frequency range (400-4000 Hz), and continues to become more like a semicircle as it gets closer to the design frequency (830 Hz). The polar response of the diffusers was measured using DIRAC software. This type of diffusers can generate a uniform polar response over the frequency range 400 Hz-4000 Hz. The high diffusivity of the diffusers in the usable frequency range 400-4000 Hz reflects a success and effectiveness of the first and second designed diffusers.

Figure 10:
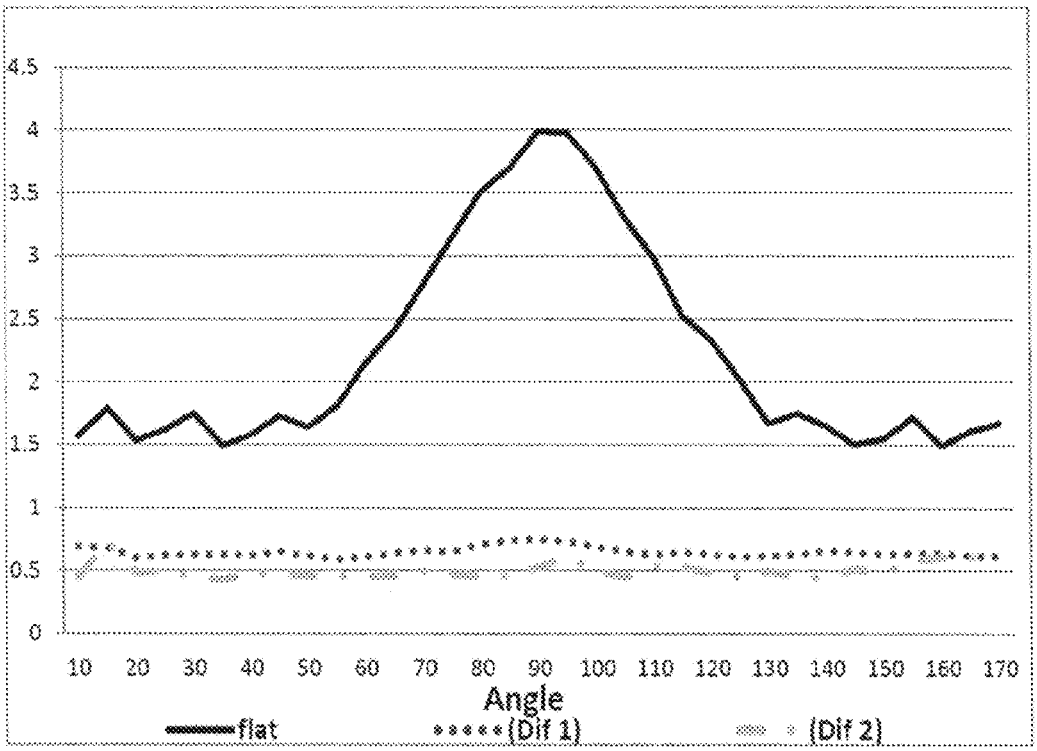
FIG. 10 is an echo criterion (EC speech) for the first and second sound diffusers according to FIGS. 2 and 4.
Figure 11:
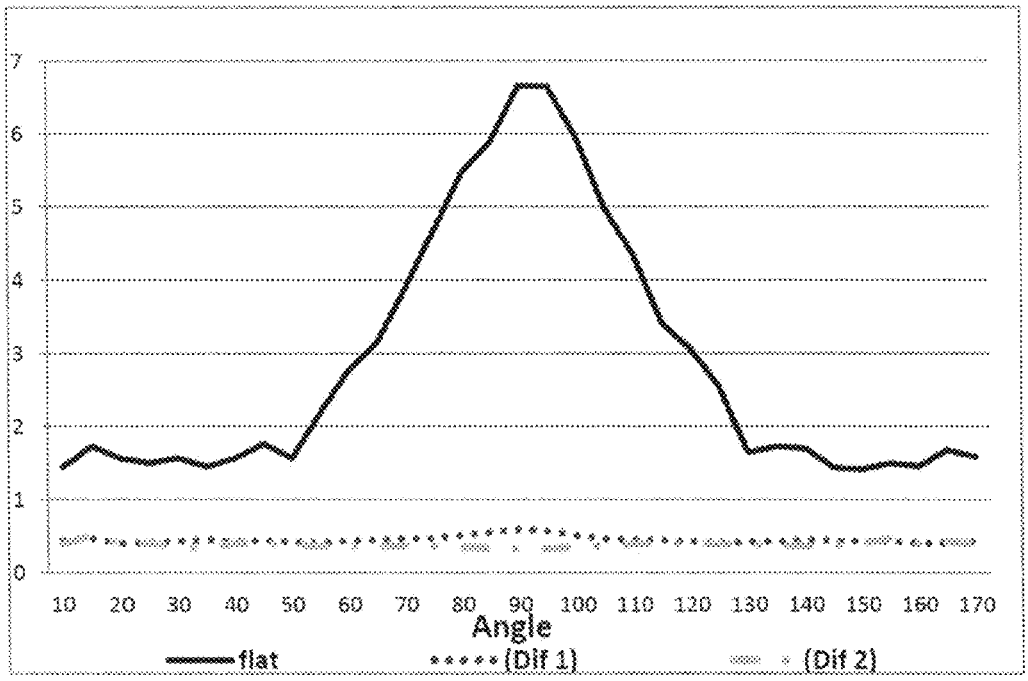
FIG. 11 is a second echo criterion (EC music) for the first and second sound diffusers according to FIGS. 2 and 4.

Echo criterion (EC) is a criterion for the perceptibility of sound coloration or of a flutter echo. The value of EC should not exceed 1.8 seconds for music and 1.0 second for speech according to the architectural acoustics standards. By comparing the results of EC speech and EC music in FIGS. 10 and 11 respectively, it can be seen that both values remain stable when using the diffusers, while they increase steeply and peak at the 90° angle when using a flat panel. In addition, the value of speech starts from 1.5 seconds for the flat panel, which is considered above the recommended value for speech. In contrast, the value of EC music and EC speech does not exceed the recommended values and it is not affected by the receiver location when using the diffuser.

Figure 12:
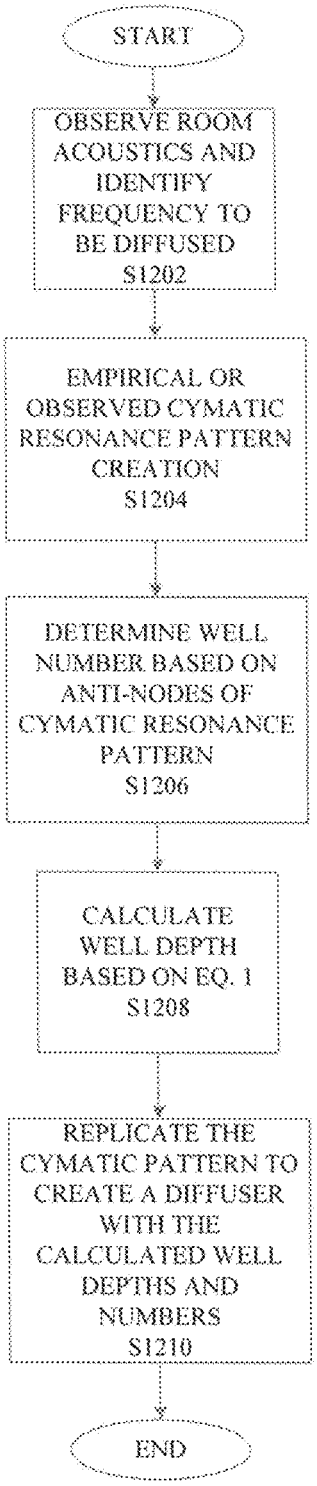
FIG. 12 is a flowchart describing the process of designing a cymatic sound diffuser according to one example.

FIG. 12 is a flowchart illustrating the process of designing a cymatic sound diffuser. The process begins at step S1202 where the room acoustics are observed and a DIRAC (B&K 7841) software is used to measure the room's acoustic parameters. Although FIG. 12 shows the room's acoustics being measured first, the room's acoustics may alternatively be observed after the diffusers have been installed. The process then proceeds to step S1204 where a cymatic resonance pattern is excited at particular frequencies by a frequency generator. Then at step S1206 where the anti-nodes of the cymatic resonance pattern are used to determine the number of wells required in the desired diffusor. At step S1208, previously discussed eq. 1 is used to determine the depth of the wells, the calculated depths and the number of wells are then used at step S1210 to create a diffusor replicating the design of the cymatic resonance pattern created in step S1204.

Figure 13:
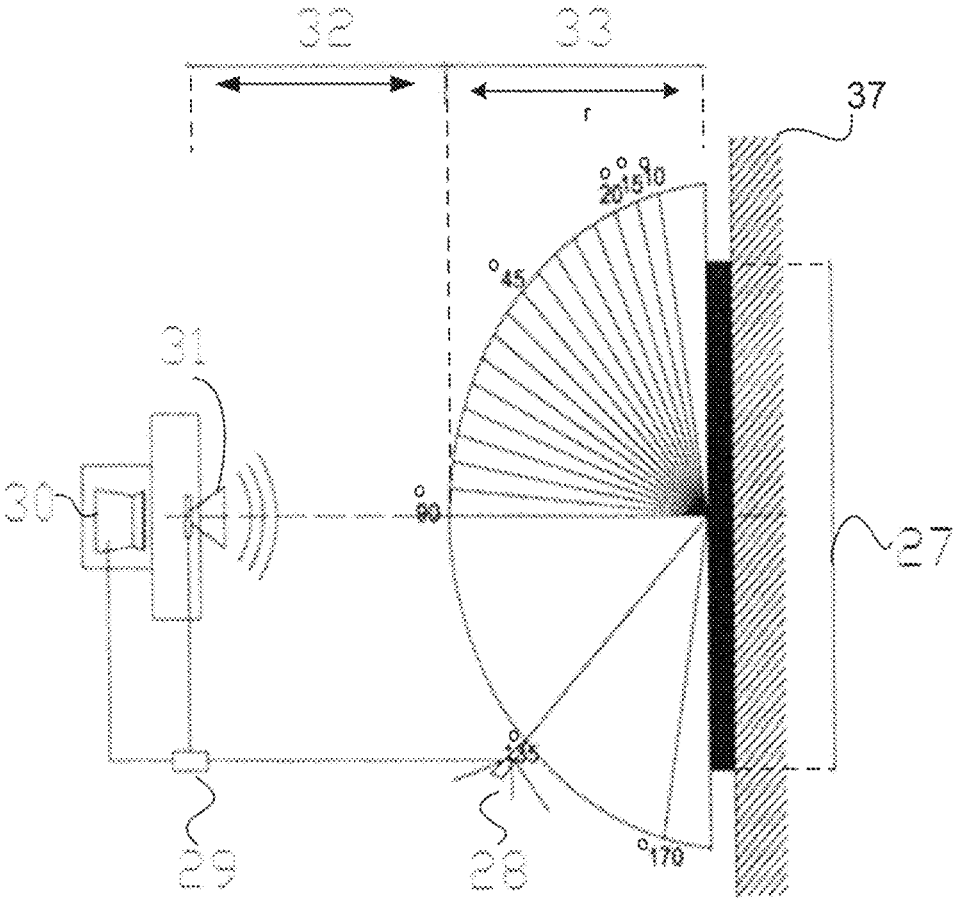
FIG. 13 is an illustrative top view of the experiment configurations to test the sound diffuser according to one example.
Figure 14:
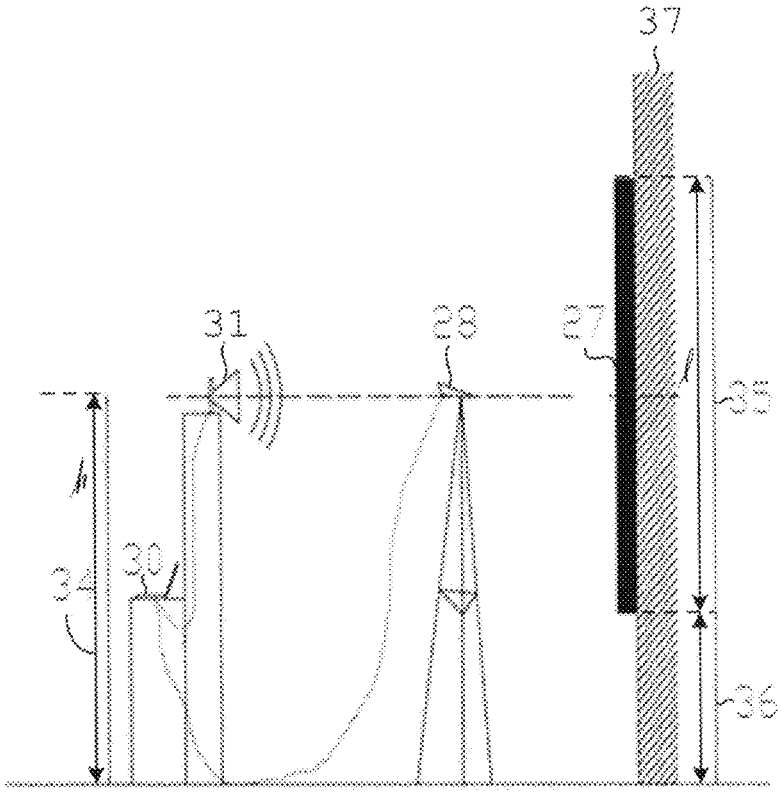
FIG. 14 is an illustrative side view of the experiment configurations to test the sound diffuser according to one example.

FIGS. 13 and 14 are the side and top views of an example experiment configurations to test the sound diffuser. The diffusers 27 are made of MDF panels and the panels are painted to maximize reflections and to minimize absorption losses by closing pores. The total length "l" of the combined diffusers 35 is 168 cm, and it was installed on the wall 37 with a distance 36 that equals 66 cm form floor. DIRAC (B&K 7841) software mentioned before was used to measure room acoustic parameters by analyzing impulse response. The system requires a PC 30, an impulsive sound source 31, a microphone 28 and a sound device 29 that connects the sound source 31 and the microphone 28 with the PC 30.

To run the software, the receiver (microphone) 28 is connected to the input channel, and the sound source (speaker) 31 is connected to the output channel of the sound device 29 (USB Audio Interface ZE-0948). This device is connected to the laptop as a USB device.

The sound source 31 (4224 B&K loudspeaker) is positioned 2 m from diffusers 27, meaning the distance of each of 32 and 33 is 1 m, and at a height "h" 34 of 1.5 m. The sound receiver 28 (2250 B&K sound field microphone) is located at points that are at equal intervals in a half circle of 1 m radius "r" 33 and the impulse responses are subsequently recorded. The receiver 28 is then moved by 5° on each occasion, starting from an angle of 10 degrees to an angle of 170°. The first and last two angles were neglected in order to avoid the reflection of the diffusers' edges.

Figure 15:
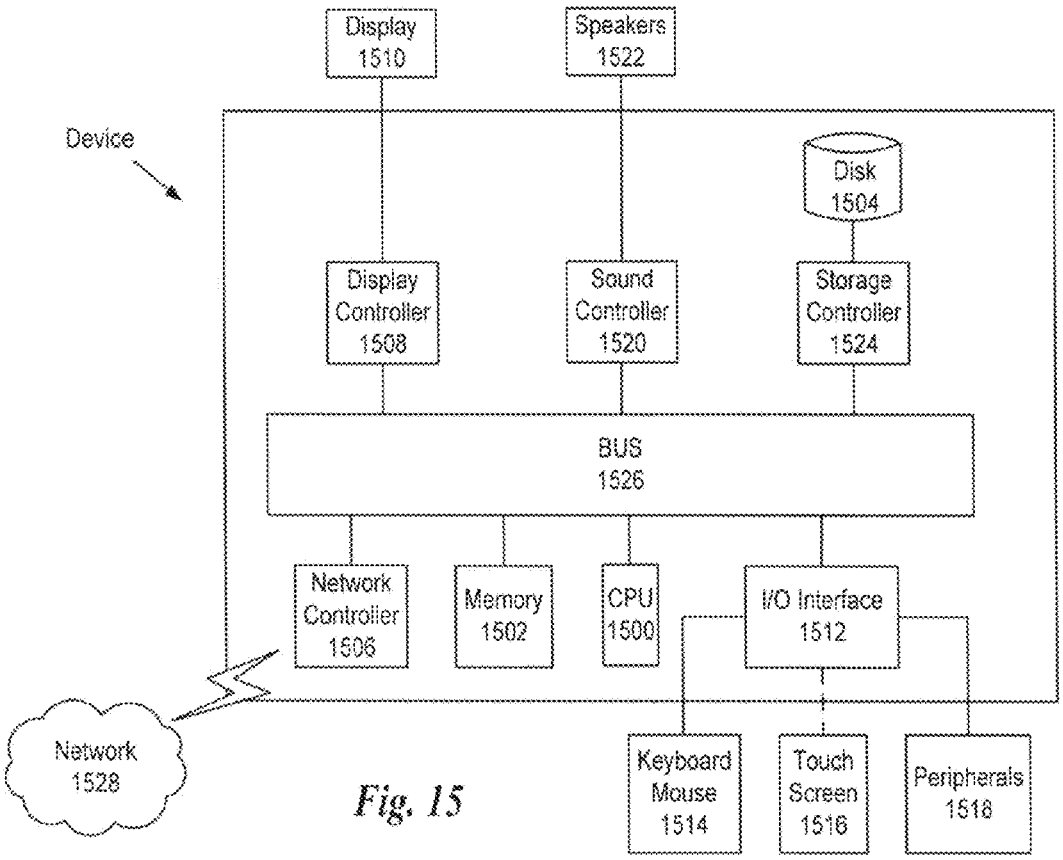
FIG. 15 is a schematic of an exemplary hardware configuration of the processing circuitry.

Next, a hardware description of the processing circuitry according to exemplary embodiments is described with reference to FIG. 15. In FIG. 15, the processing circuitry includes a CPU 1500 which performs the processes described above. The process data and instructions may be stored in memory 1502. These processes and instructions may also be stored on a storage medium disk 1504 such as a hard drive (HDD) or portable storage medium or may be stored remotely. Further, the claimed advancements are not limited by the form of the computer-readable media on which the instructions of the inventive process are stored. For example, the instructions may be stored on CDs, DVDs, in FLASH memory, RAM, ROM, PROM, EPROM, EEPROM, hard disk or any other information processing device with which the processing circuitry communicates, such as a server or computer.

Further, the claimed advancements may be provided as a utility application, background daemon, or component of an operating system, or combination thereof, executing in conjunction with CPU 1500 and an operating system such as Microsoft Windows 7, UNIX, Solaris, LINUX, Apple MAC-OS and other systems known to those skilled in the art.

CPU 1500 may be a Xenon or Core processor from Intel of America or an Opteron processor from AMD of America, or may be other processor types that would be recognized by one of ordinary skill in the art. Alternatively, the CPU 1500 may be implemented on an FPGA, ASIC, PLD or using discrete logic circuits, as one of ordinary skill in the art would recognize. Further, CPU 1500 may be implemented as multiple processors cooperatively working in parallel to perform the instructions of the inventive processes described above.

The processing circuitry in FIG. 15 also includes a network controller 1506, such as an Intel Ethernet PRO network interface card from Intel Corporation of America, for interfacing with network 1528. As can be appreciated, the network 1528 can be a public network, such as the Internet, or a private network such as an LAN or WAN network, or any combination thereof and can also include PSTN or ISDN sub-networks. The network 1528 can also be wired, such as an Ethernet network, or can be wireless such as a cellular network including EDGE, 3G and 4G wireless cellular systems. The wireless network can also be WiFi, Bluetooth, or any other wireless form of communication that is known.

The processing circuitry further includes a display controller 1508, such as a NVIDIA GeForce GTX or Quadro graphics adaptor from NVIDIA Corporation of America for interfacing with display 1510, such as a Hewlett Packard HPL2445w LCD monitor. A general purpose I/O interface 1512 interfaces with a keyboard and/or mouse 1514 as well as a touch screen panel 1516 on or separate from display 1510. General purpose I/O interface also connects to a variety of peripherals 1518 including printers and scanners, such as an OfficeJet or DeskJet from Hewlett Packard.

A sound controller 1520 is also provided in the processing circuitry, such as Sound Blaster X-Fi Titanium from Creative, to interface with speakers/microphone 1522 thereby providing sounds and/or music.

The general purpose storage controller 1524 connects the storage medium disk X04 with communication bus 1526, which may be an ISA, EISA, VESA, PCI, or similar, for interconnecting all of the components of the processing circuitry. A description of the general features and functionality of the display 1510, keyboard and/or mouse 1514, as well as the display controller 1508, storage controller 1524, network controller 1506, sound controller 1520, and general purpose I/O interface 1512 is omitted herein for brevity as these features are known.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosures, including any readily discernible variants of the teachings herein, define, in part, the scope of the foregoing claim terminology such that no inventive subject matter is dedicated to the public.

The invention claimed is:

1. A sound diffuser comprising:

a panel that have an irregular outer surface with a plurality of wells formed therein in a cymatic organization, wherein each of the plurality of wells are arranged relative to one another in a predetermined cymatic pattern, and a depth set according to well position^2 mod N, where N is a number of wells and is also a prime number.

2. The diffuser according to claim 1 wherein the first well is positioned to direct sound away a source of the sound.

3. The diffusor according to claim 1 wherein the panel has an outer perimeter of a predetermined shape.

4. The diffusor according to claim 1 wherein a number of the plurality of wells is determined by the cymatic pattern on the panel.

5. The diffusor according to claim 1 wherein the wells are arranged in a diagonal or semi-circular manner with respect to an edge of the panel.

6. The diffusor according to claim 1 wherein the wells are curved.

7. The diffusor according to claim 1 wherein the wells depth is calculated according to a QRD sequence.

8. The diffusor according to claim 1 wherein the panel comprising wood, metal, studiofoam, or thermoplastic.

9. The diffusor according to claim 1 further comprising:

at least one fin that is detachable attachable to the diffuser.

10. The diffusor according to claim 1 wherein:

the panel includes a second plurality of wells formed therein in another cymatic organization that is different than the predetermined cymatic pattern.

11. The diffusor according to claim 1 wherein an interior volume of the diffuser hollow or solid.

12. A method of making a sound diffuser, comprising:

determining a cymatic pattern on a panel, said cymatic pattern being associated with a predetermined frequency;

forming on the panel having an irregular outer surface a plurality of wells formed in the cymatic pattern;

arranging each of the plurality of wells relative to one another in the cymatic pattern;

calculating with processing circuitry a well depth set according to well position^2 mod N, where N is a number of wells and is also a prime number, and forming the wells according to well depths calculated in the calculating step.

13. The method according to claim 12, wherein a first well is positioned to direct sound away a source of the sound.

14. The method according to claim 12, wherein the panel has an outer perimeter of a predetermined shape.

15. The method according to claim 12, wherein a number of the plurality of wells is determined by the cymatic pattern.

16. The method according to claim 12, wherein the wells are arranged in a diagonal or semi-circular manner with respect to an edge of the panel.

17. The method according to claim 12, further comprising:

at least one fin that is detachable attachable to the diffuser.

18. The method according to claim 12, wherein the wells depth is calculated according to a QRD sequence.

19. The method according to claim 12, wherein the panel comprising wood, metal, studiofoam, or thermoplastic.

20. The method according to claim 12, wherein an interior volume of the diffuser hollow or solid.

* * * * *